US005282983A

United States Patent [19]

Yamamura et al.

[11] Patent Number: 5,282,983

[45] Date of Patent: Feb. 1, 1994

[54] FABRIC SOFTENER COMPOSITION AND AMMONIUM SALT

[75] Inventors: Masaaki Yamamura; Junichi Inokoshi; Kazutaka Shiratsuchi; Toru Hayase, all of Tochigi; Uichiro Nishimoto, Wakayama; Koshiro Sotoya, Wakayama; Tohru Katoh, Wakayama; Yoshifumi Nishimoto, Wakayama; Osamu Tachizawa, Wakayama, all of Japan

[73] Assignee: Kao Corporation, Tokyo, Japan

[21] Appl. No.: 838,700

[22] Filed: Feb. 21, 1992

Related U.S. Application Data

[63] Continuation-in-part of Ser. No. 748,599, Aug. 22, 1991, abandoned.

[30] Foreign Application Priority Data

Aug. 22, 1990 [JP] Japan ..... 2-221742

[51] Int. Cl.[5] ..... C11D 1/62

[52] U.S. Cl. ..... 252/8.6; 252/8.8; 252/544; 252/547

[58] Field of Search ..... 252/8.6, 8.7, 8.8, 8.9

[56] References Cited

U.S. PATENT DOCUMENTS

| | | | |
|---|---|---|---|
| 3,679,468 | 7/1972 | Feinauer et al. . | |
| 4,058,489 | 11/1977 | Hellsten . | |
| 4,092,253 | 5/1978 | Cuntze et al. . | |
| 4,137,180 | 1/1979 | Naik et al. . | |
| 4,281,196 | 7/1981 | Rutzen et al. . | |
| 4,360,437 | 11/1982 | Wolfes . | |
| 4,370,272 | 1/1983 | Wechsler et al. . | |
| 4,486,195 | 12/1984 | Weinstein et al. . | |
| 4,724,089 | 2/1988 | Konig et al. . | |
| 4,767,548 | 8/1988 | Kasprzak et al. . | |
| 4,795,573 | 1/1989 | Tsumadori et al. . | |
| 4,869,836 | 9/1989 | Harmalker . | |
| 4,913,829 | 4/1990 | Rutzen et al. . | |
| 4,931,216 | 6/1990 | Igarashi et al. . | |
| 4,956,447 | 9/1990 | Gosselink et al. | 252/8.8 |
| 4,975,091 | 12/1990 | Becker et al. . | |
| 5,093,014 | 3/1992 | Neillie | 252/8.6 |
| 5,133,885 | 7/1992 | Contor et al. | 252/8.7 |

FOREIGN PATENT DOCUMENTS

| | | |
|---|---|---|
| 1514276 | 6/1978 | United Kingdom . |
| 2160421 | 12/1985 | United Kingdom . |

OTHER PUBLICATIONS

Hendrickson et al, Organic Chemistry, 3rd Edition, pp. 302–309, 420–421 (1977).

*Primary Examiner*—Anthony Mc Farlane

*Attorney, Agent, or Firm*—Sughrue, Mion, Zinn, Macpeak & Seas

[57] ABSTRACT

An aqueous fabric softener composition is disclosed, which comprises water and, as a softener new material, an ammonium salt obtained by neutralizing the following Compound (A):

(A) a di-long chain type tertiary amine compound containing one group in which R represents an alkyl or alkenyl group containing from 11 to 21 carbon atom, one CONH group and one alkyl or alkenyl group containing from 11 to 22 carbon atoms with the following Compound (B):

an inorganic acid or an organic acid containing from 1 to 6 carbon atoms, or quaternizing Compound (A), or a mixture of the ammonium salt obtained by neutralizing Compound (A) with Compound (B) and the ammonium salt obtained by quaternizing Compound (A). An ammonium salt obtained by neutralizing or quaternizing Compound (A) is also disclosed. The fabric softener composition of the present invention imparts the sufficient softness, the antistaticity and the resiliency (fluffy feeling) to clothes of various fibers.

10 Claims, 2 Drawing Sheets

FABRIC SOFTENER COMPOSITION AND AMMONIUM SALT

CROSS REFERENCE TO RELATED APPLICATIONS

This application is a continuation-in-part of application Ser. No. 07/748,599, filed Aug. 22, 1991, now abandoned.

FIELD OF THE INVENTION

The present invention relates to a novel ammonium salt and a fabric softener composition. More particularly it relates to an ammonium salt and a liquid fabric softener composition which impart an improved softness and resiliency (fluffy feeling) to clothes of various fibers.

BACKGROUND OF THE INVENTION

The large majority of home laundering agents available on the market today under the name of softeners are compositions based on quaternary ammonium salts containing two long-chain alkyl groups within the molecule, such as di-hydrogenated tallow-alkyl dimethylammonium chloride, for instance. This is because quaternary ammonium salts produce satisfactory softening effects on various fibers even when used in small quantities.

However, despite their remarkable softening effects on cotton and the like, the above-mentioned quaternary ammonium salts are less effective for synthetic fibers such as acrylic, polyester and polyamide fibers. Moreover, if they are used in high concentrations, the resiliency and the feel of clothes are adversely affected.

Furthermore, the above quaternary ammonium salts are so hydrophobic that when put in rinse water, they are not well dispersed at low to moderate pulsator speeds and tend to be deposited unevenly on the clothes. In addition, particularly when they are stored at low temperature for a prolonged time, these compositions tend to gain in viscosity and form gels or undergo phase separation. The commercial softeners contain, in addition to the quaternary ammonium salts, such additives as polyoxyethylene nonionic surfactants, electrolytes, solvents, and the like for improving the dispersibility and shelf life but the effects are not as satisfactory as desired.

Liquid softeners containing various amines as softener bases are also known. By way of illustration, a textile softening composition containing a long-chain alkylamine such as methyl di-hydrogenated tallow-alkylamines is described in JP-A-52-59796 (the term "JP-A" as used herein means "unexamined published Japanese Patent Application") (corresponding to GB-1514276); a textile finishing composition containing an acylated alkanolamine, a water-soluble quaternary ammonium salt and a fatty acid ester for imparting smoothness and the pleasing feel is disclosed in JP-A-58-60070 (corresponding to U.S. Pat. No. 4,446,034); a highly-dispersible softener containing a quaternary ammonium compound, a higher fatty acid-hydroxy(lower)alkylpolyamine condensate, and an alkylamine polyglycol ether is disclosed in JP-A-61-167083 (corresponding to U.S. Pat. No. 4,776,965); a stable aqueous dispersion for textile treatment which contains a di(higher alkyl)cyclic amine and a Brønsted acid is disclosed in JP-A-61-275474 (corresponding to U.S. Pat. No. 4,724,089); a softening composition containing a di-long chain alkylamine-anionic surfactant ion pair complex, a non-silicone wax and a liquid vehicle is disclosed in JP-A-64-85368 (corresponding to U.S. Pat. No. 4,913,828); a textile conditioning composition containing an amine such as a hydroxy(lower)alkylalkylenediamine-higher fatty acid condensate and an amphoteric textile conditioner is disclosed in JP-A-2-6662 (corresponding to EP-332270); a textile conditioning composition containing a di(long chain) alkylamine-polycarboxylic acid complex for imparting flexibility and antistaticity to fabrics is disclosed in JP-A-2-14076 (corresponding to U.S. Pat. No. 4,869,836).

Furthermore, JP-A-52-5394 (corresponding to U.S. Pat. No. 4,045,361) discloses a fabric conditioner comprising a mono- or di(long chain)alkyl-alkylenediamine antistatic agent and a quaternary ammonium softening agent.

However, these amine-containing softeners are not sufficient in the ability to soften the substrate fabrics, although they are superior to those softening compositions based on quaternary ammonium salts in dispersibility and shelf life.

SUMMARY OF THE INVENTION

The present inventors have conducted extensive studies of amine-containing softener compositions. As a result, they found that an ammonium salt obtained by neutralizing or quaternizing a specific di-long chain amine compound is superior in the softening effect and it imparts sufficient resiliency (fluffy feeling) to clothes. The present invention is completed on the above findings.

Accordingly, the present invention provides an aqueous fabric softener composition comprising water and, as a softener raw material, an ammonium salt obtained by neutralizing the following Compound (A):

(A) a di-long chain tertiary amine compound containing one $$R-\overset{\overset{\displaystyle O}{\|}}{C}-O-$$

group wherein R represents an alkyl or alkenyl group containing from 11 to 21 carbon atoms, one —CONH— group and one alkyl or alkenyl group containing from 11 to 22 carbon atoms, with (B) an inorganic acid or an organic acid containing from 1 to 6 carbon atoms, or by quaternizing Compound (A), or a mixture of the ammonium salt obtained by neutralizing Compound (A) with Compound (B) and the ammonium salt obtained by quaternizing Compound (A).

The present invention further provides an ammonium salt obtained by neutralizing Compound (A) with Compound (B) or quaternizing Compound (A).

DETAILED DESCRIPTION OF THE INVENTION

Figure 1:
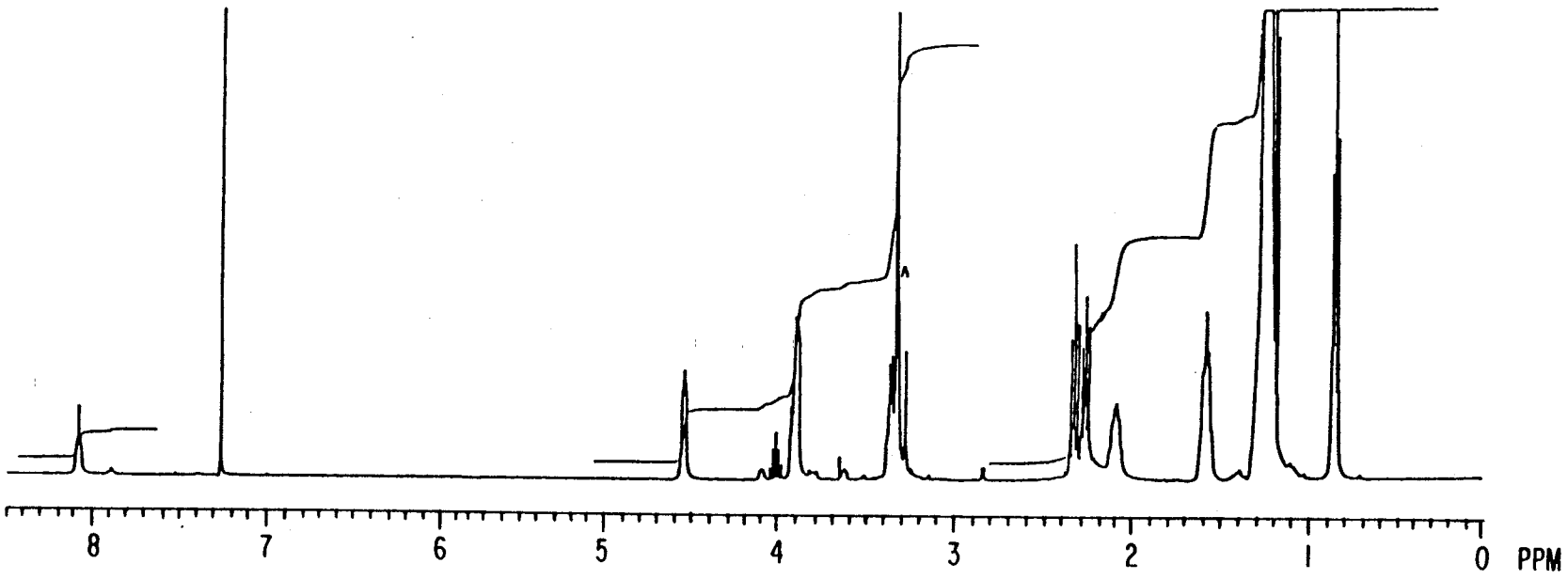
FIG. 1 is the NMR spectra of the ammonium salt synthesized in Example 1.
Figure 2:
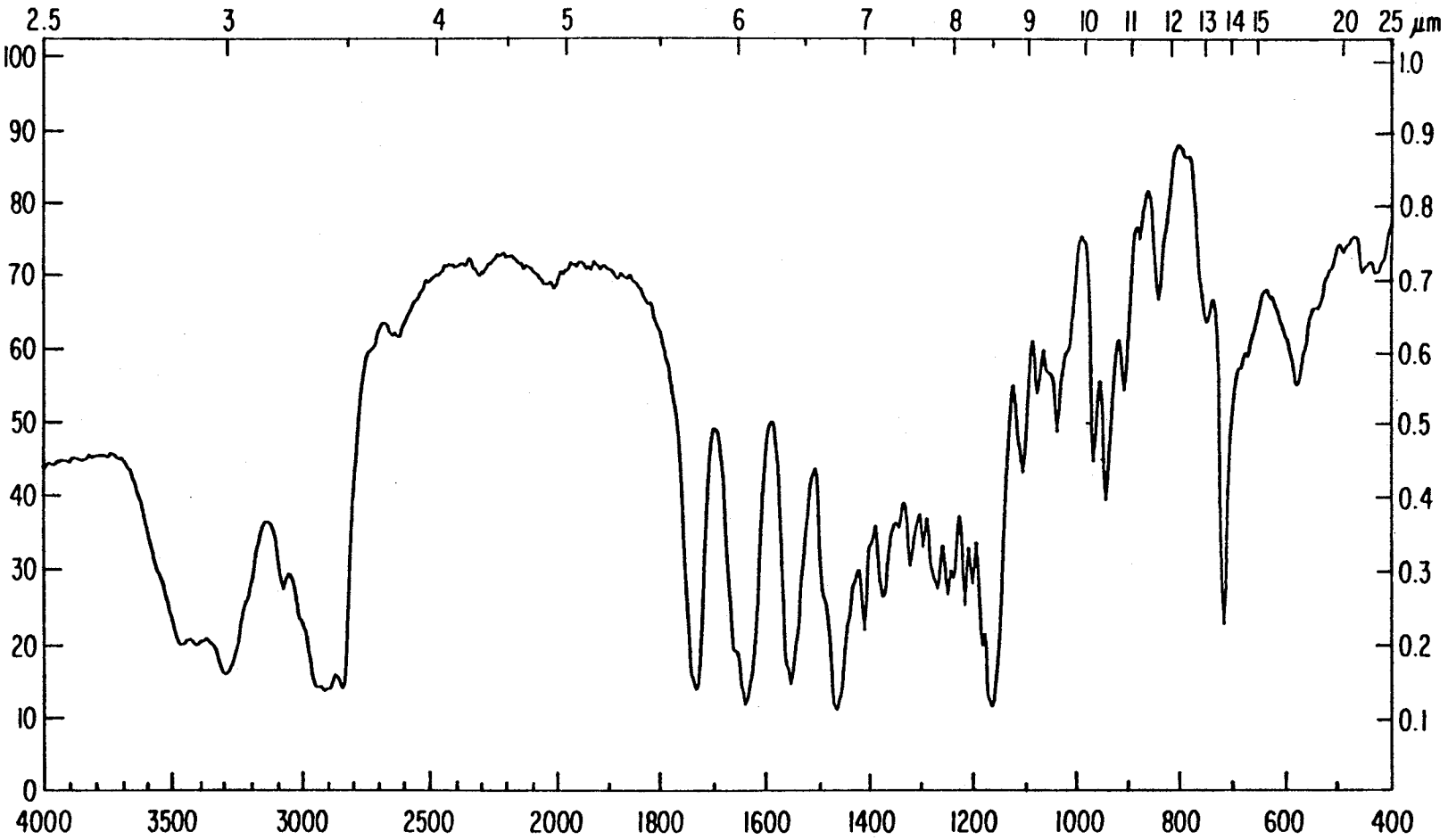
FIG. 2 is the IR spectra of the ammonium salt synthesized in Example 2.

The substituent R in the di-long chain tertiary amine compound (A) is an alkyl or alkenyl group containing from 11 to 21 carbon atoms, preferably from 13 to 19 carbon atoms and more preferably from 15 to 17 carbon atoms. These groups may be a straight-chain or branched, though straight-chain ones are preferred. Specific examples thereof include, for example, n-heptadecyl, n-pentadecyl, n-heptadecenyl and n-pentadecenyl.

The di-long chain tertiary amine compound (A) (hereinafter referred to as "Compound (A)), which is a precursor of the softener raw material to be contained in the fabric softener composition of the invention, is any of the compounds of the following formulas (A-1) through (A-3):

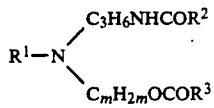
(A-1)

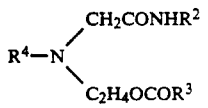
(A-2)

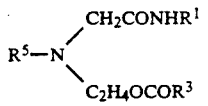
(A-3)

wherein, $R^1$ represents an alkyl or hydroxyalkyl group containing from 1 to 4 carbon atoms;

$R^2$, $R^3$ each represents an alkyl or alkenyl group containing from 11 to 21 carbon atoms;

$R^4$ represents an alkyl group containing from 1 to 4 carbon atoms;

$R^5$ represents an alkyl or alkenyl group containing from 12 to 22 carbon atoms; and m is an integer of from 2 to 9.

Specific and preferred examples of the group represented by $R^1$ include, for example, methyl group and hydroxyethyl group. As the alkyl or alkenyl group represented by $R^2$, those containing from 13 to 20 carbon atoms are preferred and those containing from 15 to 18 carbon atoms are more preferred. As the alkyl or alkenyl group represented by $R^3$, those containing from 13 to 19 carbon atoms are preferred and those containing from 15 to 17 carbon atoms are more preferred. Specific and preferred example of the group represented by $R^4$ include, for example, methyl group. As the alkyl or alkenyl group represented by $R^5$, those containing from 14 to 20 carbon atoms are preferred and those containing from 16 to 18 carbon atoms are more preferred. The symbol m is preferably 2. The alkyl or alkenyl group represented by $R^2$ or $R^3$ may be straight-chain or branched, though straight-chain ones are preferred.

The compounds of formulas (A-1) though (A-3) can be used either alone or a mixture of two or more of them.

The compound (A-1) can be synthesized by reacting: a compound of formula (AB-1):

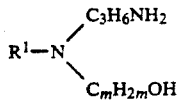
(AB-1)

wherein $R^1$ and m are as defined hereinbefore, which can be obtained by cyanoethylation and hydrogenation of an N-lower alkylalkanolamine, a dialkanolamine (e.g., diethanolamine) or an N-alkyl-N-alkanol obtained by reacting an alkylene halohydrin (e.g, 9-bromo-1-nonanol) with an N-lower alkylamine, with a fatty acid containing 12 to 22 carbon atoms.

The compound (A-2) can be synthesized by subjecting a compound of formula (AB-2):

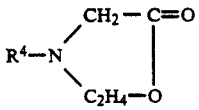
(AB-2)

wherein $R^4$ is as defined hereinbefore, which can be obtained by intramolecular dehydrative ring-formation reaction of an N-lower alkyldiethanolamine, to ring-opening amidation with an aliphatic amine such as laurylamine or stearylamine, and reacting the resulting amide with a fatty acid halide containing from 12 to 22 carbon atoms such as stearoyl chloride.

The compound (A-3) can be synthesized by reacting: a compound of formula (AB-3):

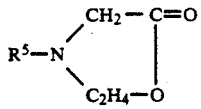
(AB-3)

wherein $R^5$ is as defined hereinbefore, which can be obtained by intramolecular dehydrative ring-formation reaction of an N-higher alkyl or alkenyldiethanolamine with a lower alkylamine such as methylamine, ethylamine or butylamine, and further with a fatty acid halide containing from 12 to 22 carbon atoms such as stearoyl chloride.

The fatty acid to be used in the synthesis of the compounds of formulas (A-1) though (A-3) are those containing from 12 to 22 carbon atoms, preferably from 14 to 20 carbon atoms, and more preferably from 16 to 18 carbon atoms. Specific examples thereof include, for example, palmitic acid, stearic acid, oleic acid and elaidic acid.

The acid (B) to be used to neutralize Compound (A) which is used as the softener raw material of the fabric softener composition of the invention includes inorganic acids such as hydrochloric acid, nitric acid, phosphoric acid, sulfuric acid and so on; and organic acids containing from 1 to 6 carbon atoms, such as acetic acid, lactic acid, glycolic acid, citric acid, maleic acid and so on, although hydrochloric acid is preferred in that it is most inexpensive and effective.

Regarding the neutralization process of Compound (A), it is optional to neutralize Compound (A) beforehand and disperse it in water, or to pour Compound (A), whether in liquid form or in solid form, into an aqueous solution of the acid. Of course, Compound (A) and the acid may be simultaneously added to water.

The quaternization of Compound (A) can be accomplished through a known method, for example, using a lower alkyl halide or a di-lower alkyl sulfate.

Examples of the lower alkyl halide include those containing a halogen atom (e.g., chlorine atom, bromine atom) and having 1 or 2 carbon atoms such as methyl chloride while examples of the di-lower alkyl sulfate include those having 1 or 2 carbon atoms such as dimethyl sulfate and diethyl sulfate.

The lower alkyl halide or the di-lower alkyl sulfate (hereinafter referred to as a "quaternizing agent") is reacted with Compound (A) in a molar ratio of the quaternizing agent to Compound (A) of 1/1 to 3/1. When an amount of the quaternizing agent is smaller than the range, the reaction yield tends to lower. On the other hand, when an amount of the quaternizing agent is larger than the range, the quaternizing agent may remain in the reaction product.

The quaternization is preferably conducted at a temperature of from 30° to 120° C., more preferably at a temperature of from 50° to 90° C. The quaternization can be carried out either without solvents or in the presence of an alcoholic solvent such as ethanol, isopropanol, and the like. The quaternization can be carried out without using a catalyst.

As the ammonium salt obtained by neutralizing Compound (A) with Compound (B) or by quaternizing Compound (A) with a quaternizing agent according to the present invention, ammonium salts represented by the following formulas (C-1) through (C-3) are preferred:

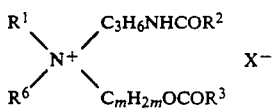

(C-1)

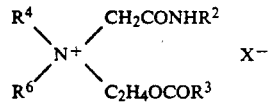

(C-2)

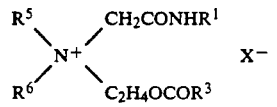

(C-3)

wherein $R^1$, $R^2$, $R^3$, $R^4$, $R^5$ and m are as defined above;

$R^6$ represents a hydrogen atom, a hydroxy group, or an alkyl group containing 1 or 2 carbon atoms; and $X^-$ represents an anion selected from the group consisting of residues of an inorganic acid and an organic acid, a halogen atom and a lower alkyl sulfate.

Specific examples of the alkyl group represented by $R^6$ include methyl and ethyl groups.

Among the group represented by $R^6$, a hydrogen atom and an alkyl group containing 1 or 2 carbon atoms are preferred.

Examples of the residue of an inorganic acid and an organic acid represented by $X^-$ include residues of the inorganic acid and the organic acid listed above for Compound (B). Specific examples the residues of the inorganic acid include groups represented by $Cl^-$, $NO_3^-$, $H_2PO_4^-$, $\frac{1}{2}HPO_4^{2-}$, $\frac{1}{3}PO_4^{3-}$, $HSO_4^-$ and $\frac{1}{2}SO_4^{2-}$ and specific examples of the residues of the organic acid include acetyl, lactoyl, glycoloyl, oxalyl and maleoyl groups. Specific examples of the halogen atom include chlorine atom and bromine atom, and specific examples of the lower alkyl sulfate include methyl sulfate and ethyl sulfate.

Among the anions for $X^-$, the group represented by $\frac{1}{2}SO_4^-$ a halogen atom and a lower alkyl sulfate are preferred.

Specific and preferred examples of the ammonium salt of the present invention are mentioned below.

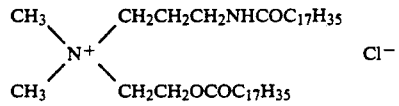

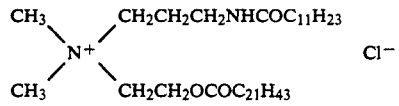

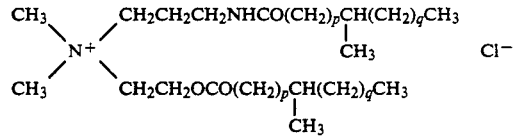

wherein p and q each represents a value of from 0 to 16, provided that the sum of p and q is from 10 to 16.

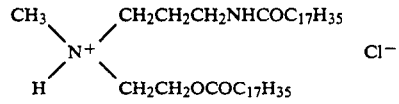

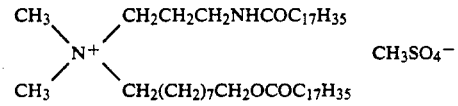

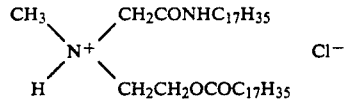

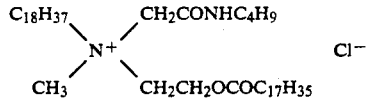

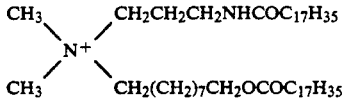

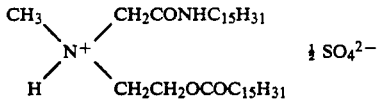

For the preparation of a fabric softener composition containing the ammonium salt obtained by neutralizing or quaternizing Compound (A) of the invention as an essential ingredient, it is preferable that the total amount of the ammonium salt obtained by neutralizing Compound (A and the ammonium salt obtained by quaternizing Compound (A) in the fabric softener composition of the invention ranges from 4 to 40% by weight, preferably 6 to 30% by weight, and more preferably from 10 to 30% by weight, based on the total weight of the composition, in view of the viscosity of the final product and ease of handling. The balance of the composition can be water.

In the fabric softener composition of the invention, a silicone compound such as dimethylpolysiloxane or a partially amino- or polyoxyalkylene-modified dimethylpoly-siloxane, particularly a partially polyoxyalkylene-modified dimethylpolysiloxane can be added in addition to the ammonium salt obtained by neutralizing Compound (A) and/or the ammonium salt obtained by quaternizing Compound (A) and water. In this case, the feel of the clothes finished by such a fabric softener composition can be improved without detracting the water-absorbing property of the clothes. Such a silicone compound is preferably used in the fabric softener composition of the invention in a proportion of from 0.3 to 5% by weight based the total weight of the ammonium salt obtained by neutralizing Compound (A) and the ammonium salt obtained by quaternizing Compound (A) of the present invention.

The fabric softener composition of the invention imparts to clothes of various fibers a softness with bouncy while giving the softening effect equivalent to that of dihydrogenated tallow-alkyl dimethylammonium chloride, which has been widely used in the art.

In an aqueous liquid fabric softener composition of the invention, it is preferable to control the viscosity of the final product by adding an inorganic electrolyte, such as sodium chloride, calcium chloride, magnesium chloride or the like, in a proportion of from 0.05 to 0.4% by weight based on the total weight of the composition.

Although the fabric softener composition of the invention has a long shelf life, it can be further stabilized for assurance of the quality of the composition under severe storage conditions by incorporating additives including nonionic surfactants such as polyoxyethylene (5–50 moles)-alkyl or alkenyl($C_{12-24}$) ethers, polyoxyethylene (5–50 moles)-alkyl or alkenylamines; solvents such as ethanol, isopropyl alcohol, propylene glycol and ethylene glycol; and/or urea.

Moreover, esters, nonionic or cationic compounds, long-chain alcohols, and the like, which are known as a softener raw material, may be incorporated in the fabric softener composition of the invention.

Furthermore, there may be further incorporated in the fabric softener composition of the invention a pigment or a dye for improving appearance of the product, a fluorescent whitener for improving finished whiteness, and a perfume for improving a sensory value during use and after finishing.

The fabric softener composition of the invention can be prepared in the form of a solution, a suspension, an emulsion or the like in a conventional manner.

The fabric softener composition of the present invention imparts the sufficient softness, the antistaticity and the resiliency (fluffy feeling) to clothes of various fabrics.

The present invention is illustrated by the following examples in further detail. However, the present invention is not restricted thereby.

EXAMPLE 1

Synthesis of N-[3-(stearoylamino)propyl]-N-[2-(stearoyloxy)ethyl]-N,N-dimethylammonium chloride 248 g of stearic acid and 66 g of N-(2-hydroxyethyl)-N-methyl-1,3-propylenediamine were introduced to a four-neck flask equipped with a stirrer, a thermometer and a dehydration tube and heated to 180° C. At the temperature, heating was continued for 10 hours while removing water formed course of reaction. After completion of the heating, 300 g of the reaction mixture was dissolved to 60 g of isopropyl alcohol and the resulting solution was introduced to an autoclave equipped with a stirrer, a thermometer and a pressure meter. Then, 28 g of methyl chloride was forcedly introduced to the autoclave and reaction was allowed to proceed at 100° C. for 8 hours. After completion of the reaction, isopropyl alcohol was removed under a reduced pressure, thereby 320 g of the aimed compound was obtained. Based on an NMR spectra and an IR spectra, it was confirmed that the resulting compound had the following structure.

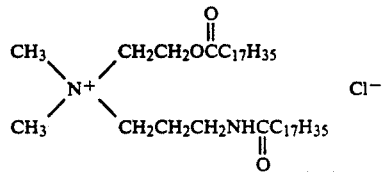

NMR Spectra ($CDCl_3$, Internal Standard TMS):

2.1 ppm (m, 2H, (N—C—$\underline{CH_2}$—C—N)), 2.3 ppm (t, 2H), 2.35 ppm (t, 2H, (OC—$\underline{CH_2}$—, NHC—$\underline{CH_2}$—)), 3.3 ppm (s, 6H, ($(\underline{CH_3})_2N^+$—)), 3.35 ppm (q, 2H, (—$\underline{CH_2}$—NHCO—)), 3.9 ppm (m, 4H, (—$\underline{CH_2}$—$N^+$—$\underline{CH_2}$—)) 4.55 ppm (t, 2H, (—$\underline{CH_2}$—OC—)), 8.1 ppm (t, 1H, (—N$\underline{H}$C—))

IR Spectra (KBr pellet): 1734 $cm^{-1}$, 1642 $cm^{-1}$, 1466 $cm^{-1}$, 1188 $cm^{-1}$.

EXAMPLE 2

Synthesis of N-[3-(lauroylamino)propyl]-N-[2-(behenoyloxy)ethyl]-N,N-diemthylammonium chloride 100 g of lauric acid and 66 g of N-(2-hydroxyethyl)-N-methyl-1,3-propylenediamine were introduced to a four-neck flask equipped with a stirrer, a thermometer and a dehydration tube and heated to 180° C. At the temperature, heating was continued for 3 hours while removing water formed course of reaction. Next, 170 g of behenic acid was added to the reaction mixture and the reaction was further proceeded at 180° C. for 8 hours. After completion of reaction, 280 g of the reaction mixture was dissolved to 55 g of isopropyl alcohol and the resulting solution was introduced to an autoclave equipped with a stirrer, a thermometer and a pressure meter. Then, 28 g of methyl chloride was forcedly introduced to the autoclave and reaction was allowed to proceed at 100° C. for 8 hours. After completion of the reaction, isopropyl alcohol was removed under a reduced pressure, thereby 300 g of the aimed compound was obtained. Based on an NMR spectra and an IR spectra, it was confirmed that the resulting compound had the following structure.

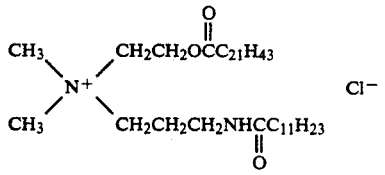

NMR Spectra ($CDCl_3$, Internal Standard TMS):

2.1 ppm (m, 2H, (N—C—$\underline{CH_2}$—C—N)), 2.3 ppm (t, 2H), 2.35 ppm (t, 2H, (OC—$\underline{CH_2}$—, NHC—$\underline{CH_2}$—)), 3.3 ppm (s, 6H, (($\underline{CH_3}$)$_2$N$^+$—)), 3.35 ppm (q, 2H, (—$\underline{CH_2}$—NHCO—)), 3.9 ppm (m, 4H, (—$\underline{CH_2}$—N$^+$—$\underline{CH_2}$—)), 4.55 ppm (t, 2H, (—$\underline{CH_2}$—OC—)), 8.0 ppm (t, 1H, (—N$\underline{H}$C—))

IR Spectra (KBr pellet): 1733 $cm^{-1}$, 1642 $cm^{-1}$, 1466 $cm^{-1}$, 1188 $cm^{-1}$.

EXAMPLE 3

Synthesis of N-[3-(stearoylamino)propyl]-N-[9-stearoyloxy)nonyl]-N,N -dimethylammonium methylsulfate 400 g a 40% aqueous solution of methylamine and 180 g of 9-chlorononanol were introduced into an autoclave equipped with a stirrer, a thermometer and a pressure pump and heated to 100° C. At the temperature, 93 g of a 48% aqueous solution of sodium hydroxide was forcedly introduced to the autoclave over 6 hours and the resulting mixture was aged for 1 hours. After cooling, the content was taken out from the autoclave and unreacted methylamine and water were removed therefrom under reduced pressure. Then, ethanol was added thereto and sodium chloride thus precipitated was filtered off. Ethanol was distilled off from the filtrate and the resulting solution was further subjected to distillation to give 125 g of 9-(N-methylamino)nonanol.

120 g of 9-(N-methylamino)nonanol was introduced to an autoclave equipped with a stirrer, a thermometer, a pressure meter and a drop funnel, 36.8 g of acrylonitrile was added thereto dropwise at 70° C. and the resulting mixture was aged for 1 hour. Then, 7.8 g of Raney nickel was added to the mixture and hydrogen gas was introduced to the autoclave till the inner pressure reached to 20 kg/cm$^2$.G to thereby allow hydration reaction to proceed at 60° C. for 8 hours. After cooling, the content was taken out from the autoclave and subjected to distillation to give 122 g of N-(9-hydroxynonyl)-N-methyl-1,3-propylenediamine.

284 g of stearic acid and 115 g of N-(9-hydroxynonyl)-N-methyl-1,3-propylenediamine were introduced to a four-neck flask equipped with a stirrer, a thermometer and a dehydration tube and heated to 180° C. At the temperature, heating was continued for 10 hours while removing water formed course of reaction. After cooling the reaction mixture, 70 g of isopropyl alcohol was added to the mixture and the resulting mixture was heated to 60° C. At the temperature, 62 g of dimethyl sulfate was dropwise added to the mixture over 2 hours. After aging for 5 hours, isopropyl alcohol was distilled off from the reaction mixture, thereby 420 g of the aimed compound was obtained. Based on an NMR spectra and an IR spectra, it was confirmed that the resulting compound had the following structure.

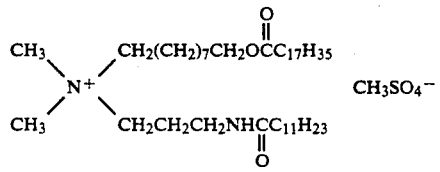

NMR Spectra ($CDCl_3$, internal standard TMS):

2.1 ppm (m, 2H, (N—C—$\underline{CH_2}$—C—N)), 2.3 ppm (t, 2H), 2.35 ppm (t, 2H, (OC—$\underline{CH_2}$—, NHC—$\underline{CH_2}$—)), 3.3 ppm (s, 6H, (($\underline{CH_3}$)$_2$N$^+$—)), 3.4 ppm (q, 2H, (—$\underline{CH_2}$—NHCO—)), 3.8 ppm (s, 3H, ($\underline{CH_3}$SO$_4^-$)), 3.9 ppm (m, 4H, (—$\underline{CH_2}$—N$^+$—$\underline{CH_2}$—)), 4.4 ppm (t, 2H, (—$\underline{CH_2}$—OC—)), 8.0 ppm (t, 1H, (—N$\underline{H}$C—))

IR Spectra (KBr pellet): 1731 $cm^{-1}$, 1640 $cm^{-1}$, 1466 $cm^{-1}$, 1188 $cm^{-1}$.

EXAMPLE 4

Synthesis of N-[3-(isostearoylamino)propyl]-N-[2-(isostearoyloxy)ethyl]-N,N-dimethylammonium chloride The procedure of Example 1 was repeated except that 280 g of Emersol 87 (trade name, manufactured by EMERY) was used in place of stearic acid, thereby the aimed compound having the following formula was obtained.

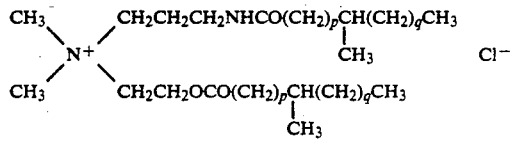

wherein p and q each represents a value of from 0 to 16, provided that the sum of p and q is from 10 to 16.

EXAMPLE 5

Synthesis of Hydrochloric acid salt N-[3-(stearoylamino)propyl]-N-[2-(stearoyloxy)ethoxy)ethyl]-N-methylamine Stearic acid and N-(hydroxyethyl)-N-methyl-1,3-propylenediamine were reacted as in the manner of Example 1 and 300 g the resulting product was dropwise added to a four-neck flask containing 1500 g of water and 49 g a 35% hydrochloric acid. Water was removed from the resulting mixture by freeze-drying, thereby the aimed compound was obtained. Based on an NMR spectra and an IR spectra, it was confirmed that the resulting compound had the following structure.

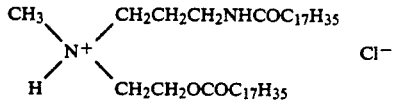

NMR Spectra ($CDCl_3$, Internal Standard TMS):

2.05 ppm (m, 2H, (N—C—$\underline{CH_2}$—C—N)), 2.2 ppm (t, 2H), 2.35 ppm (t, 2H, (OC—$\underline{CH_2}$—, NHC—$\underline{CH_2}$—)), 2.75 ppm (s, 3H, ($\underline{CH_2}$—$N^+$—), 3.05 ppm (t, 2H, (N—$\underline{CH_2}$—C—C—NHCO)), 3.2 ppm (t, 2H, (N—$\underline{CH_2}$—C—O—CO)), 3.4 ppm (q, 2H, (—$\underline{CH_2}$—NHCO—)), 4.5 ppm (t, 2H, (—$\underline{CH_2}$—OC—)), 7.1 ppm (t, 1H, (—N$\underline{H}$C—)), 12.0 ppm (br, 1H, (N$\underline{H}$))

IR Spectra (KBr pellet): 1740 $cm^{-1}$, 1647 $cm^{-1}$, 1470 $cm^{-1}$, 1167 $cm^{-1}$.

EXAMPLE 6

Hydrochloric acid salt of N-[3-(stearoylamino)methyl)-N-[2-(stearoyloxy)ethyl]-N-methylamine N-Methylmorpholone was synthesized in the manner of Example 2 of Japanese Patent Application Hei-3-20709.

Namely, dehydrative ring-formation reaction of N-methyldiethanolamine was carried out in the presence of a catalyst having the composition of Cu/Ni/Pd=5/1/0.01, thereby N-methylmorpholone was obtained.

115 g of N-methylmorpholone and 269 g of stearylamine were introduced into a four-neck flask equipped with a stirrer and a thermometer and heated to 100° C. At the temperature, reaction was proceeded for 2 hours. 350 g of acetone was added to the resulting mixture and 303.5 g of stearoyl chloride was dropwise added thereto with stirring. As a result, the aimed compound was precipitated as a while precipitate. The white precipitate was separated from acetone by filtration and then dried to thereby 560 g of the aimed compound was obtained. Based on an NMR spectra and an IR spectra, it was confirmed that the resulting compound had the following structure.

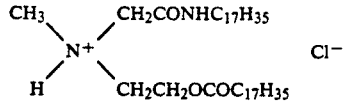

NMR Spectra ($CDCl_3$, Internal Standard TMS):

2.4 ppm (m, 2H, (O—CO—$\underline{CH_2}$—)), 3.05 ppm (s, 3H, ($\underline{CH_3}$—N)), 3.2 ppm (q, 2H, (CONH—$\underline{CH_2}$—)), 3.55 ppm (br, 1H), 3.75 ppm (br, 1H, (—N—$\underline{CH_2}$—C—OCO—)), 4.1 ppm (s, 2H, (N—$\underline{CH_2}$—CONH)), 4.5 ppm (t, 2H, (—N—$\underline{CH_2}$OCO—)), 8.6 ppm (br, 1H, (—CON$\underline{H}$—)), 11.6 ppm (br, 1H, (N$\underline{H}$))

IR Spectra (KBr pellet): 1745 $cm^{-1}$, 1675 $cm^{-1}$, 1475 $cm^{-1}$, 1158 $cm^{-1}$.

EXAMPLE 7

Synthesis of N-[(N'-butylamindo)methyl)]-N-[2-(stearoyloxy)ethyl]-N-stearyl-N-methylammonium chloride N-Stearylmorpholone was obtained in a similar manner as in the aforementioned Example 6 using N-stearyldiethanolamine.

353 g of N-stearylmorpholone and 73 g of butylamine were introduced to an autoclave equipped with a stirrer, a thermometer and a pressure meter and heated to 100° C. At the temperature, the reaction was proceeded for 2 hours. Then, 400 g of the reaction product and 800 g of acetone as a solvent were introduced to a four-neck flask equipped with a stirrer, a thermometer and a cooling tube. The content of the flask was heated to 50° C. and 285 g of stearoyl chloride and 78 g of a 48% aqueous solution of sodium hydroxide were dropwise added thereto simultaneously. The resulting mixture was aged for 3 hours at the temperature and NaCl formed was removed therefrom by filtration. The filtrate was introduced to an autoclave and 57 g of methyl chloride was forcedly introduced thereto. After reacting at 100° C. for about 8 hours, the reaction mixture was taken out from the autoclave. A white precipitate was removed from the reaction mixture by filtration and dried to thereby obtain 605 g of the aimed compound. Based on an NMR spectra and an IR spectra, it was confirmed that the resulting compound had the following structure.

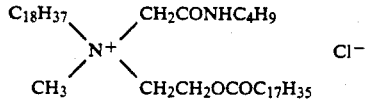

-continued

NMR Spectra ($CDCl_3$, Internal Standard TMS):

2.4 ppm (t, 2H, (O—CO—$\underline{CH_2}$—)), 3.2 ppm (q, 2H, (CONH—$\underline{CH_2}$—)), 3.35 ppm (s, 3H, ($\underline{CH_3}$—$N^+$)), 3.6 ppm (t, 2H, (—C—C—$\underline{CH_2}$—$\overset{+}{N}$—)), 3.9 ppm (t, 2H, (—$N^+$—$\underline{CH_2}$—C—OCO—)), 4.5 ppm (t, 2H, (—$\underline{CH_2}$OCO—)), 4.6 ppm (s, 2H, ($N^+$—$\underline{CH_2}$CONH—)), 9.4 ppm (t, 1H, (—CON$\underline{H}$—)), IR Spectra (KBr pellet) 1735 $cm^{-1}$, 1673 $cm^{-1}$, 1473 $cm^{-1}$, 1160 $cm^{-1}$.

EXAMPLES 8 TO 23 AND COMPARATIVE EXAMPLES 1 TO 4

The compounds used in the following examples and comparative examples are set forth in Table 1 below.

TABLE 1

| Compound | Formula | $R^1$ to $R^5$ and m in formula | Neutralizing agent | Quaternizing agent |
|---|---|---|---|---|
| A-11 | A-1 | $R^1$: Methyl<br>$R^2CO$, $R^3CO$: Hydrogenated tallow fatty acid residue<br>m: 2 | Hydrochloric acid | — |
| A-12 | A-1 | $R^1$: Hydroxyethyl<br>$R_2CO$, $R^3CO$: Oleoyl<br>m: 2 | Glycolic acid | — |
| A-13 | A-1 | $R^1$: Hydroxyethyl<br>$R^2CO$, $R^3CO$: Lauroyl/stearoyl (1:1)<br>m: 2 | — | $CH_3Cl$ |
| A-21 | A-2 | $R^2$: Stearyl<br>$R^3CO$: Lauroyl<br>$R^4$Methyl | Glycolic acid | — |
| A-22 | A-2 | $R^2$: Hydrogenated tallow alkyl<br>$R^3CO$: Stearoyl<br>$R^4$: Methyl | Hydrochloric acid | — |
| A-31 | A-3 | $R^1$: Methyl<br>$R^3CO$: Stearoyl<br>$R^5$: Stearyl | Hydrochloric acid | — |
| A-32 | A-3 | $R^1$: Methyl<br>$R^3CO$: Unhydrogenated tallow fatty acid residue<br>$R^5$: Oleyl | Acetic acid | — |
| B-1 | — | Di-hydrogenated tallow alkyl-dimethylammonium chloride | — | — |
| B-2 | B[1)] | R': Stearyl<br>R"CO: Stearoyl | Hydrochloric acid | — |

Note:
[1)]Formula (B):

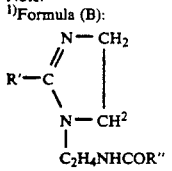

(B)

The compositions indicated in Table 2 were evaluated for the softness and the resiliency by the following test.

Evaluation Of Softness And Resiliency (1) Method:

Using a 30 l laundering machine, 2 kg of commercial cotton towels and 1 kg of acrylic jersey fabrics were laundered in 3.5° DH hard water with a commercial detergent (Attack, trade name, a product of Kao Corporation) 5 times to remove the textile finishes from the respective fibers. Then, 1.5 g of one of the compositions indicated in Table 2 was added and the wash load was treated under pulsation at 25° C. for 1 minute.

In each of the test compositions, a polyoxyethylene-modified dimethylpolysiloxane was incorporated in the amount of 1% by weight based on the total amount of the compound according to the invention. The balance was water.

(2) Evaluation method:

The fabrics treated as above were dried in the interior atmosphere and, then, allowed to stand in a constant temperature-humidity chamber controlled at 25° C. and 65% RH.

The fabrics were then evaluated for the softness and the resiliency.

The evaluation of the softness and the resiliency was performed by five expert panelists by the method of paired comparison using a fabric treated with 10 cc of a softening agent containing 15% by weight of di-hydrogenated tallow-alkyl dimethylammonium chloride as a reference control. The scoring schema was as follows.

+2: Definitely superior to control in the softness or the resiliency

+1: Slightly superior to control in the softness or the resiliency

0: Equivalent to control

−1: Slightly inferior to control in the softness or the resiliency

−2: Definitely inferior to control in the softness or the resiliency

The results are indicated by the mean values of the evaluation results of the five panelists.

TABLE 2

(Softness and resiliency)

| Formulation (% by weight) | | | Performance | |
|---|---|---|---|---|
| Compound according to the invention | | Other ingredient | Softness | Resiliency |
| Example 8 | A-11 (18) | — | +1 | +1 |
| Example 9 | A-11 (15) | B-1 (3) | 0 | +2 |
| Example 10 | A-12 (15) | — | 0 | +1 |
| Example 11 | A-13 (18) | — | +1 | +1 |
| Example 12 | A-21 (18) | — | +1 | +1 |
| Example 13 | A-21 (15) | B-2 (3) | 0 | +2 |
| Example 14 | A-22 (18) | — | +1 | +1 |
| Example 15 | A-22 (15) | B-1 (3) | +1 | +2 |
| Example 16 | A-22 (13) | B-2 (5) | +1 | +2 |
| Example 17 | A-31 (18) | — | +1 | +1 |
| Example 18 | A-31 (15) | B-1 (3) | +1 | +2 |
| Example 19 | A-32 (15) | — | 0 | +1 |
| Comparative Example 1 | — | B-1 (15) | 0 | 0 |
| Comparative Example 2 | — | B-2 (15) | 0 | 0 |

It is apparent from Table 2 that the use of the compound of the invention leads to satisfactory results in both terms of the softness and resiliency.

EXAMPLES 20 to 22 and COMPARATIVE EXAMPLES 3 and 4

Using the compositions indicated in Table 3, the stacking height of cotton towels was measured for evaluation of the resiliency.

Evaluation of resiliency

Three cotton towels, treated as in the manner of Examples 8 through 19 and each folded in 8, were stacked up and compressed under a pressure load of 5 g/cm$^2$ for 5 minutes. The pressing load was then removed and the height of the stack was measured. The higher height of the stack indicates the higher resiliency of the towels.

TABLE 3

Evaluation of resiliency (stacking height of towels)

| | Formulation | Resiliency (height of stack) (cm) |
|---|---|---|
| Example 20 | Same as Example 11 | 9.2 |
| Example 21 | Same as Example 15 | 9.4 |
| Example 22 | Same as Example 18 | 9.4 |
| Comparative Example 3 | Same as Comparative Example 1 | 8.9 |
| Comparative Example 4 | Same as Comparative Example 2 | 8.8 |

EXAMPLE 19

An aqueous fabric softener composition of the following formulation was prepared.

(Formulation)

| Component | Amount (by weight) |
|---|---|
| The neutralization product of di-long chain tertiary amine compound (A-11) | 18% |
| Polyoxyethylene (average added moles: 20) lauryl ether | 1% |
| Calcium chloride | 0.1% |
| Perfume | 0.4% |
| Dye | 20 ppm |
| Defoaming agent | 100 ppm |
| Water | balance |

This aqueous fabric softener composition imparted to clothes of softness with good resiliency. Also, this aqueous fabric softener composition showed good dispersion stability at storage for a long period of time.

While invention has been described in detail and with reference to specific examples thereof, it will be apparent to one skilled in the art that various changes and modifications can be made therein without departing from the spirit and scope thereof.

What is claimed is:

1. An aqueous fabric softener composition comprising water and an ammonium salt or water and a mixture of ammonium salts, wherein said ammonium salt is obtained by either of the following two processes (1) or (2):

(1) neutralizing the following Compound (A):

(A) a tertiary amine compound containing one

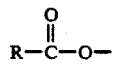

group wherein R represents an alkyl or alkenyl group containing from 11 to 21 carbon atoms; one —CONH— group; and one alkyl or alkenyl group containing from 11 to 22 carbon atoms with (B) an inorganic acid or an organic acid containing from 1 to 6 carbon atoms, or (2) quaternizing said Compound (A), and wherein said mixture of ammonium salts comprises a mixture of (i) said ammonium salt obtained by process (1) by neutralizing said Compound (A) with said Compound (B) and (ii) said ammonium salt obtained by process (2) by quanternizing said Compound (A).

2. The aqueous fabric softener composition of claim 1, wherein said Compound (A) is at least one compound selected from the compounds represented by formulas (A-1) through (A-3):

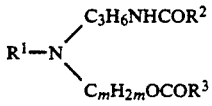

(A-1)

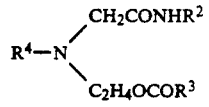

(A-2)

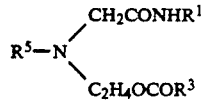

(A-3)

wherein, $R^1$ represents an alkyl or hydroxyalkyl group containing from 1 to 4 carbon atoms;

$R^2$, $R^3$ each represents an alkyl or alkenyl group containing from 11 to 21 carbon atoms;

$R^4$ represents an alkyl group containing from 1 to 4 carbon atoms;

$R^5$ represents an alkyl or alkenyl group containing from 12 to 22 carbon atoms; and m is an integer of from 2 to 9.

3. The aqueous fabric softener composition of claim 1, wherein said Compound (A) is quaternized with methyl chloride or a dialkyl sulfate.

4. The aqueous fabric softener composition of claim 1, wherein a total amount of said ammonium salt ranges from 4 to 40% by weight based on the total weight of the composition.

5. An ammonium salt obtained by neutralizing the following Compound (A):

(A) a tertiary amine compound containing one

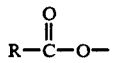

group wherein R represents an alkyl or alkenyl group containing from 11 to 21 carbon atom, one CONH group and one alkyl or alkenyl group containing from 11 to 22 carbon atoms with (B) an inorganic acid or an organic acid containing from 1 to 6 carbon atoms, or quaternizing said Compound (A).

6. The ammonium salt of claim 5, wherein said Compound (A) is at least one compound selected from the compounds represented by formulas (A-1) through (A-3):

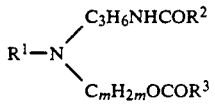

(A-1)

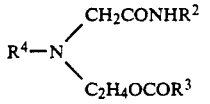

(A-2)

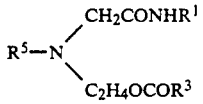

(A-3)

wherein, $R^1$ represents an alkyl or hydroxyalkyl group containing from 1 to 4 carbon atoms;

$R^2$, $R^3$ represents an alkyl or alkenyl group containing from 11 to 21 carbon atoms;

$R^4$ represents an alkyl group containing from 1 to 4 carbon atoms;

$R^5$ represents an alkyl or alkenyl group containing from 12 to 22 carbon atoms; and m is an integer of from 2 to 9.

7. The ammonium salt of claim 5, wherein said Compound (A) is quaternized with methyl chloride or a di-methyl or di-ethyl sulfate.

8. The ammonium salt of claim 5, wherein said ammonium salt is represented by the following formula (C-1), (C-2) or (C-3):

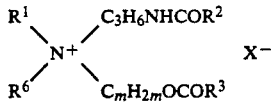

(C-1)

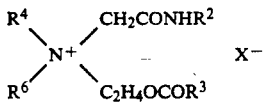

(C-2)

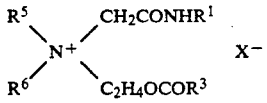

(C-3)

wherein $R^1$ represents an alkyl or hydroxyalkyl group containing from 1 to 4 carbon atoms;

$R^2$, $R^3$ each represents an alkyl or alkenyl group containing from 11 to 21 carbon atoms;

$R^4$ represents an alkyl group containing from 1 to 4 carbon atoms;

$R^5$ represents an alkyl or alkenyl group containing from 12 to 22 carbon atoms;

$R^6$ represents a hydrogen atom, a hydroxy group, or an alkyl group containing 1 or 2 carbon atoms;

$X^-$ represents an anion selected from the group consisting of an anion of an inorganic acid and an anion of an organic acid; and m is an integer or from 2 to 9.

9. The ammonium salt of claim 8, wherein $R^6$ represents a hydrogen atom or an alkyl group containing 1 or 2 carbon atoms and $X^-$ represents a halogen atom, a methyl or ethyl or a group represented by $\frac{1}{2}SO_4^{2-}$.

10. The ammonium salt of claim 8, wherein $X^-$ represents a halogen ion, a methyl sulfate or an ethyl sulfate.

* * * * *